US005353818A

United States Patent [19]

Suzuki et al.

[11] Patent Number: 5,353,818

[45] Date of Patent: Oct. 11, 1994

[54] AIRTIGHT COMPACT CASE

[75] Inventors: Kazuo Suzuki; Masahiro Sumise; Kazuo Suzuki, all of Tokyo, Japan

[73] Assignees: KOSÉ Corporation; Yoshino Kogyosho Co., Ltd., both of Tokyo, Japan

[21] Appl. No.: 172,729

[22] Filed: Dec. 27, 1993

[30] Foreign Application Priority Data

Mar. 12, 1993 [JP] Japan ..... 5-10812[U]
Nov. 8, 1993 [JP] Japan ..... 5-59905[U]

[51] Int. Cl.[5] ..... A45D 33/24

[52] U.S. Cl. ..... 132/300; 132/294; 132/315

[58] Field of Search ..... 132/294, 295, 296, 300, 132/314, 315; 206/581, 823

[56] References Cited

U.S. PATENT DOCUMENTS

| | | | |
|---|---|---|---|
| 2,035,832 | 3/1936 | Parkin | 132/300 |
| 2,148,077 | 2/1939 | Lampl | 132/300 |
| 2,399,997 | 5/1946 | Flaster | 132/300 |
| 3,256,892 | 6/1966 | Esposito, Jr. | 132/300 |
| 4,863,034 | 9/1989 | Contreras, Sr. | 132/294 |
| 5,078,159 | 1/1992 | Yuhara | 132/315 |

FOREIGN PATENT DOCUMENTS 58-171617 10/1983 Japan .
58-181305 10/1983 Japan .
3-119315 5/1991 Japan .

*Primary Examiner*—Gene Mancene
*Assistant Examiner*—Frank A. LaViola
*Attorney, Agent, or Firm*—Oliff & Berridge

[57] ABSTRACT

A cover is pivotably attached to a case body. Male thread portions of a multiple thread and unthreaded portions are alternately formed on a peripheral wall of a cosmetic container section of the case body. A ring is rotatably attached to the cover and externally fitted to the peripheral wall. The ring has female thread portions of a multiple thread intermittently formed. The female and male thread portions are engageable and disengageable. An inner cover made of an elastic material is attached to the lower portion of the cover so that the inner cover is brought into press contact with an open edge of the peripheral wall. A space is formed between the cover and the inner cover so that the inner cover is elastically deformed and expanded. When the female and the male thread portions are engaged with each other and the ring is rotated to a closed position, the cover approaches the case body so that the inner cover is brought into press contact with the open edge of the peripheral wall. When the temperature within the cosmetic container section is increased, the inner cover is elastically expanded upwards to increase the volume within the cosmetic container section. Thus, an increase in pressure within the cosmetic container section is suppressed.

12 Claims, 18 Drawing Sheets

AIRTIGHT COMPACT CASE

BACKGROUND OF THE INVENTION

This invention relates to a cosmetic compact case capable of airtightly sealing a cosmetic container section.

Conventional compact cases of the type described are disclosed in Japanese Utility Model Laid-Open Nos. 171617/1983 and 181305/1983. Each of these compact cases comprises a case body, a cover having one end pivotably attached to one end of the case body, and engaging members attached to the other ends of the case body and the cover. A cosmetic container section defined by an inner tray can be kept airtight by sealing an open edge of the inner tray with a packing material. The above-mentioned compact cases of an airtight sealing type can prevent a cosmetic product in the inner tray from evaporating and leaking out to be reduced in amount when the cosmetic product contains an evaporable substance.

The above-mentioned conventional compact cases have no serious problem inasmuch as they are used in an environment without any substantial temperature variation. If they are placed in an environment subjected to a wide temperature variation, however, sealing becomes insufficient due to a pressure variation within the cosmetic container section following the temperature variation. This may result in generation of an air flow into and out of the inner tray.

Japanese Utility Model Laid-Open No. 119315/1991 discloses another compact case of an airtight sealing type having a different structure. The compact case comprises a case body, a cover pivotably attached to the case body, and a ring rotatably attached to the cover. When the ring is rotated, a multiple thread mechanism formed between the ring and an inner tray brings the cover into press contact with the case body. A cylindrical packing member made of an elastic material such as rubber is attached to the cover with a tongue at its top end obliquely downwardly directed. When the ring is tightened, the tongue of the packing member is pressed against an upper surface of a peripheral edge of the inner tray and is bent in press contact therewith.

In this compact case, the tongue is deeply bent in press contact with the inner tray. Being bent so deeply, it takes a long time to restore the tongue of the packing member to its original shape before it is bent, when the cover is opened after a long time closure. In the event that the cover is closed immediately after it is opened in such a manner, the tongue and the inner tray often fail to be brought into tight contact with each other. As a consequence, the cosmetic container section can not be sealed successfully.

SUMMARY OF THE INVENTION

In view of the above, it is an object of this invention to reliably seal a cosmetic container section even if a compact case is used in an environment subjected to wide temperature variation.

It is another object of this invention to clearly indicate that a ring is located at an open position or a closed position when the ring is rotated.

It is a further object of this invention to restrict deformation of an inner cover which is elastically deformed in press contact with a peripheral wall of a cosmetic container section when a ring is located at a closed position.

An airtight compact case according to this invention comprises (a) a case body having a cosmetic container section surrounded by a peripheral wall; (b) a cover pivotably attached to a rear end of the case body; (c) an elastic inner cover attached to a lower portion of the cover for sealing an open edge of the peripheral wall; (d) a cavity defined between a lower surface of the cover and the inner cover; (e) a ring rotatably and unreleasably attached to the lower portion of the cover and externally fitted to the peripheral wall of the case body; (f) a plurality of male thread portions intermittently formed as a multiple thread on an outer surface of the peripheral wall of the case body; (g) a plurality of unthreaded portions formed on the outer surface of the peripheral wall of the case body between the male thread portions; and (h) a plurality of female thread portions intermittently formed as a multiple thread on an inner peripheral surface of the ring to be engageable with and disengageable from the male thread portions so that the cover is allowed to be opened when the female thread portions meet the unthreaded portions and that the cover is brought into press contact with the case body and the inner cover is put into press contact with the peripheral wall when the ring is rotated with the female thread portions engaged with the male thread portions.

In the above-mentioned airtight compact case, an open position of the ring is defined as a position where the female thread portions of the ring meet the unthreaded portions of the peripheral wall of the case body. When the ring is located at the open position, the cover is allowed to be rotated with respect to the case body so that the cover can be opened. When the cover is put on the case body while the ring is located at the open position, a lower surface of the inner cover is brought into contact with the open edge of the peripheral wall of the case body.

In this state, let the ring be rotated in a closing direction to engage the female thread portions of the ring with the male thread portions formed on the peripheral wall. When the ring is tightened to reach a closed position, the cover approaches the case body and the inner cover is brought into press contact with the open edge of the peripheral wall to seal the cosmetic container section.

Since the female and the male thread portions are formed as multiple threads, it is possible to securely seal the cosmetic container section. In addition, the female and the male thread portions are intermittently formed. If a lead angle of each of these thread portions is selected to be large, the inner cover is readily brought into strong press contact with the open edge of the peripheral wall only by a small angle rotation of the ring.

In the above-mentioned airtight compact case, it is assumed that the temperature within the cosmetic container section is raised while the cover is closed and the ring is located at the closed position. In this event, the inner cover is elastically expanded upwards to thereby increase the volume of the cosmetic container section. Thus, an increase in pressure within the cosmetic container section is suppressed. It is therefore possible to avoid interruption of the sealing condition of the cosmetic container section.

On the contrary, when the temperature within the cosmetic container section is decreased to cause a negative pressure therein, the inner cover is elastically bent downwards. It is thus possible to prevent a further decrease in pressure within the cosmetic container section.

As described above, even if the airtight compact case is used in the environment subjected to wide temperature variation, the cosmetic container section automatically varies its volume through elastic deformation of the inner cover. In this manner, variation in pressure within the cosmetic container section is minimized to thereby keep airtightness of the cosmetic container section.

The airtight compact case is most suitable for a cosmetic product containing an evaporable substance.

The case body and the cover may be formed in an elliptical shape to provide the case body with a puff container section adjacent to the cosmetic container section.

Preferably, an outer peripheral portion of the ring is outwardly protruded from the case body and the cover so as to facilitate manipulation of the ring.

Preferably, a spring for urging the ring in the closing direction is interposed between the cover and the ring so as to inhibit the ring from being undesirably loosened due to vibration or the like.

A cutoff portion may be formed on a rear wall of each of the case body and the cover while a protrusion is formed on the outer peripheral portion of the ring so that the protrusion meets the cutoff portion to close the cutoff portion when the ring is located at the closed position. With this structure, the airtight compact case is improved in appearance on the rear side.

A stopper may be formed on the lower surface of the cover to protrude therefrom. In this event, the ring is provided with an opening-side contact piece, an opening-side elastic piece, a closing-side contact piece, and a closing-side elastic piece protruding from an upper surface of the ring. These contact pieces and elastic pieces are arranged so that the opening-side elastic piece passes over the stopper and the opening-side contact piece is brought into contact with the stopper when the ring is rotated towards the open position and that the closing-side elastic piece passes over the stopper and the closing-side contact piece is brought into contact with the stopper when the ring is rotated towards the closed position. With this structure, a click sound is generated when the stopper passes over each elastic piece. This structure is advantageous in that it is possible to audibly confirm that the ring is at the open or the closed position.

The inner cover may be attached either directly to the cover or to the lower portion of the ring. The inner cover may be attached in either manner inasmuch as the inner cover can be brought into press contact with the open edge of the peripheral wall of the case body.

The airtight compact case according to this invention may comprise inner and outer annular contact members formed on an upper surface of the inner cover to be brought into contact with the lower surface of the cover, and an intermediate annular contact member formed between the inner and the outer annular contact members. On the other hand, a body-side annular contact member is formed on an upper surface of the peripheral wall of the case body to be brought into contact with a lower surface of the inner cover at a position below the intermediate annular contact member. Each of the contact members may be formed as a contact surface.

When the inner and the outer annular contact members are put in slight contact with the lower surface of the cover, the intermediate annular contact member is faced to the lower surface of the cover with a gap left therebetween. When the inner and the outer annular contact members are brought into strong press contact with the lower surface of the cover, the intermediate annular contact member is brought into press contact with the lower surface of the cover.

With this structure, when the ring is rotated to the closed position, the intermediate annular contact member of the inner cover is not moved down because its lower surface is supported by the body-side annular contact member. On the other hand, the inner and the outer annular contact members are put into relatively strong press contact with the lower surface of the cover and pressed down. As a consequence, a peripheral portion of the inner cover is curved in an arcuate shape to be elastically brought into press contact with the body-side annular contact member. When the cover is brought into contact with the intermediate annular contact member, the peripheral portion of the inner cover is not curved any longer. Thus, the degree of the bend of the peripheral portion of the inner cover is restricted.

Therefore, the inner cover is prevented from being curved and bent to the extent such that a next closure is unsuccessful. Even if the cover is closed immediately after it is opened, the inner cover can be elastically brought into press contact with the body-side annular contact member. Thus, the cosmetic container section can be reliably sealed.

Each of the inner, the outer, the intermediate, and the body-side annular contact members may be formed as a convex surface. Alternatively, a surface of a counterpart member to be contacted by each contact member may be formed into a convex shape.

The inner, the outer, and the intermediate annular contact members may be brought into direct contact with a rear surface of the cover. Alternatively, the inner cover may be attached to the lower portion of the ring so that the inner, the outer, and the intermediate annular contact members are brought into contact with a lower surface of the ring.

DETAILED DESCRIPTION OF THE PREFERRED EMBODIMENTS

Figure 1:
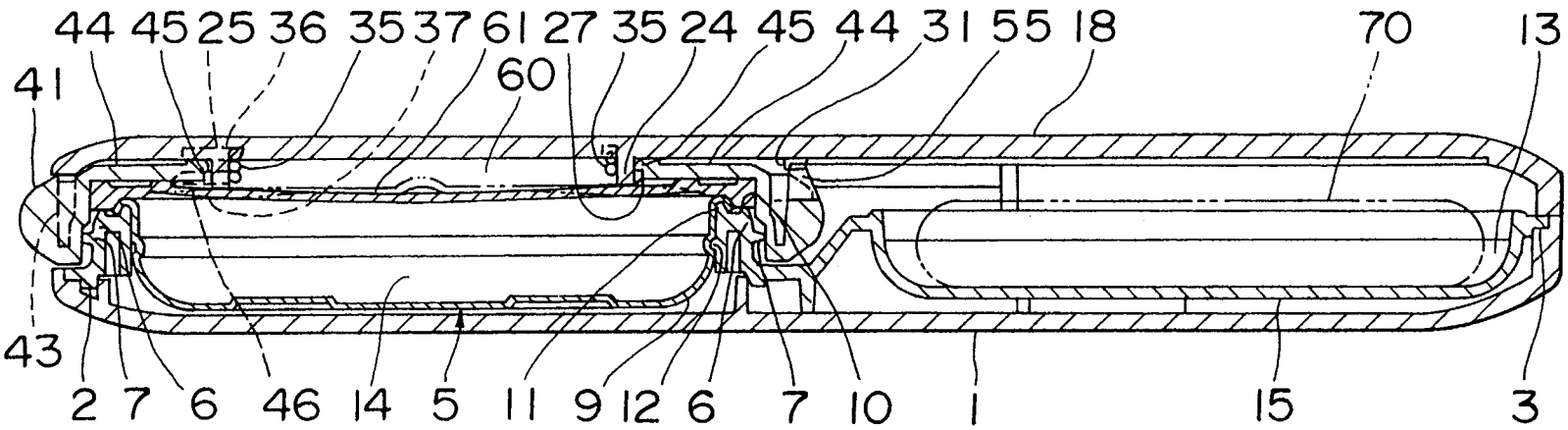
FIG. 1 is a sectional view of an airtight compact case according to a first embodiment of this invention taken along a line I—I in FIG. 2.

Now, description will be made as regards several preferred embodiments of this invention with reference to the drawing.

First Embodiment

Referring to FIGS. 1 through 8, an airtight compact case according to a first embodiment of this invention will at first be described.

The compact case comprises an elliptical case body 1 made of synthetic resin and an elliptical cover 18 made of synthetic resin. The rear end of the cover 18 is pivotably attached through an axle 19 to that of the case body 1 so that the cover 18 is opened and closed.

To the case body 1, an integral assembly made of synthetic resin comprising a peripheral wall 6 of an inner tray 5 and a second inner tray 15 is fitted in the manner which will presently be described. The case body 1 has a groove 2 formed in its periphery at the side where the inner tray 5 is fitted. The case body 1 is also provided with a step portion 3 in its periphery at the side where the second inner tray 15 is attached. A lower portion of the peripheral wall 6 of the inner tray 5 is fitted into the groove 2 while an open edge of the second inner tray 15 is engaged with the step portion 3. The interior of the second inner tray 15 defines a puff container section 13 for receiving a puff 70.

Figure 2:
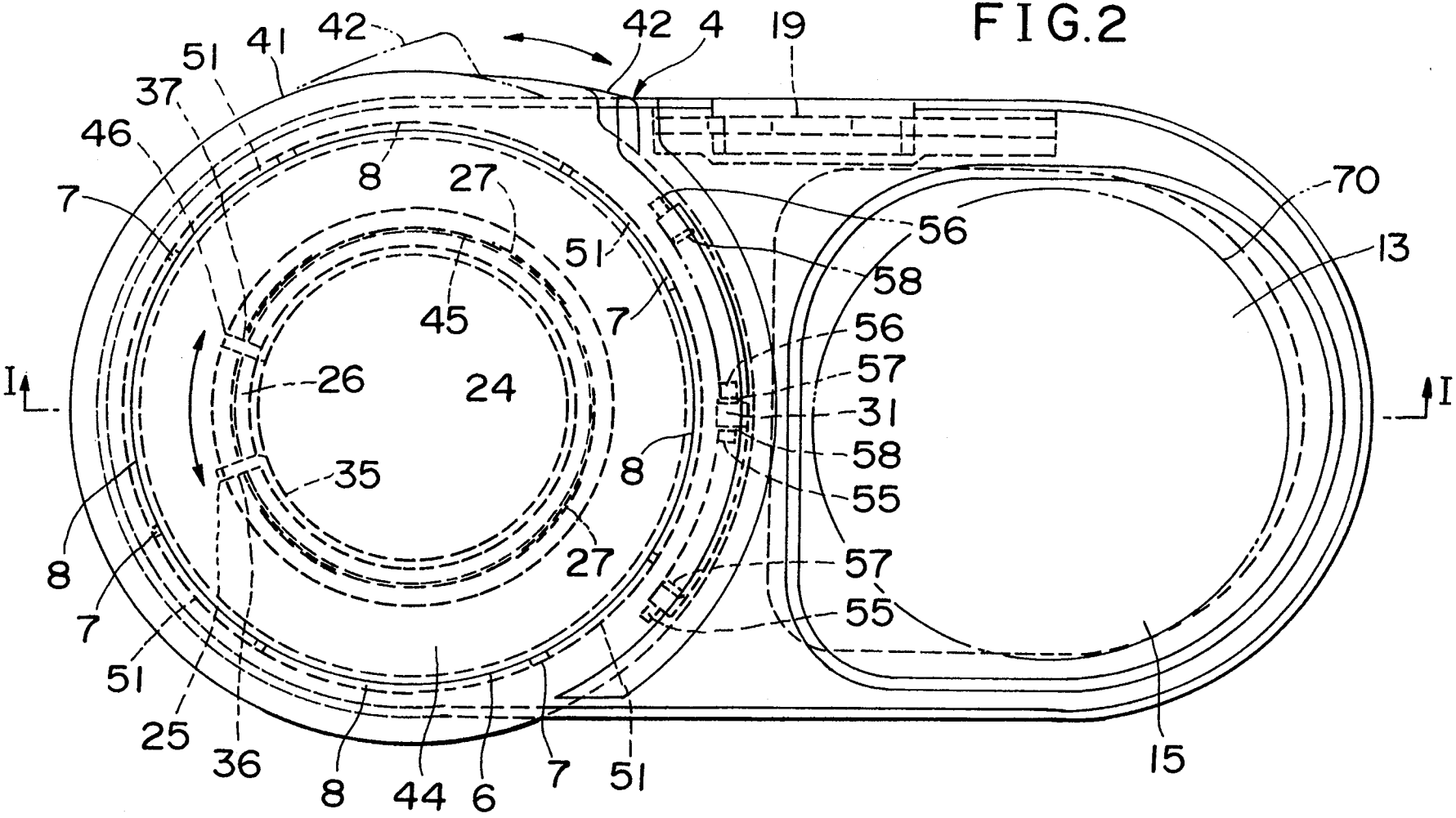
FIG. 2 is a plan view of the airtight compact case according to the first embodiment with a part of a top plate of a cover removed.
Figure 3:
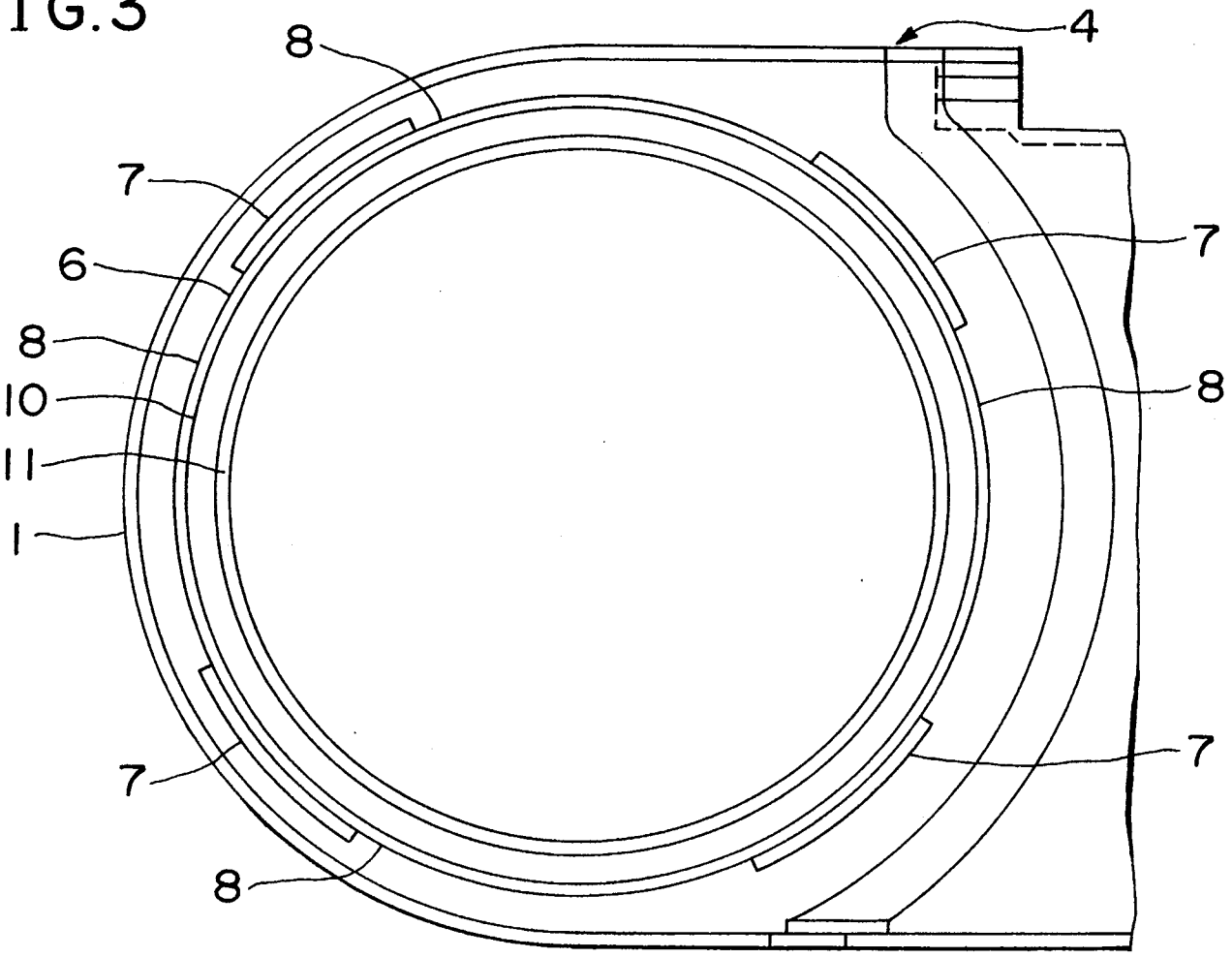
FIG. 3 is a plan view of a main part of a case body in the airtight compact case according to the first embodiment.
Figure 4:
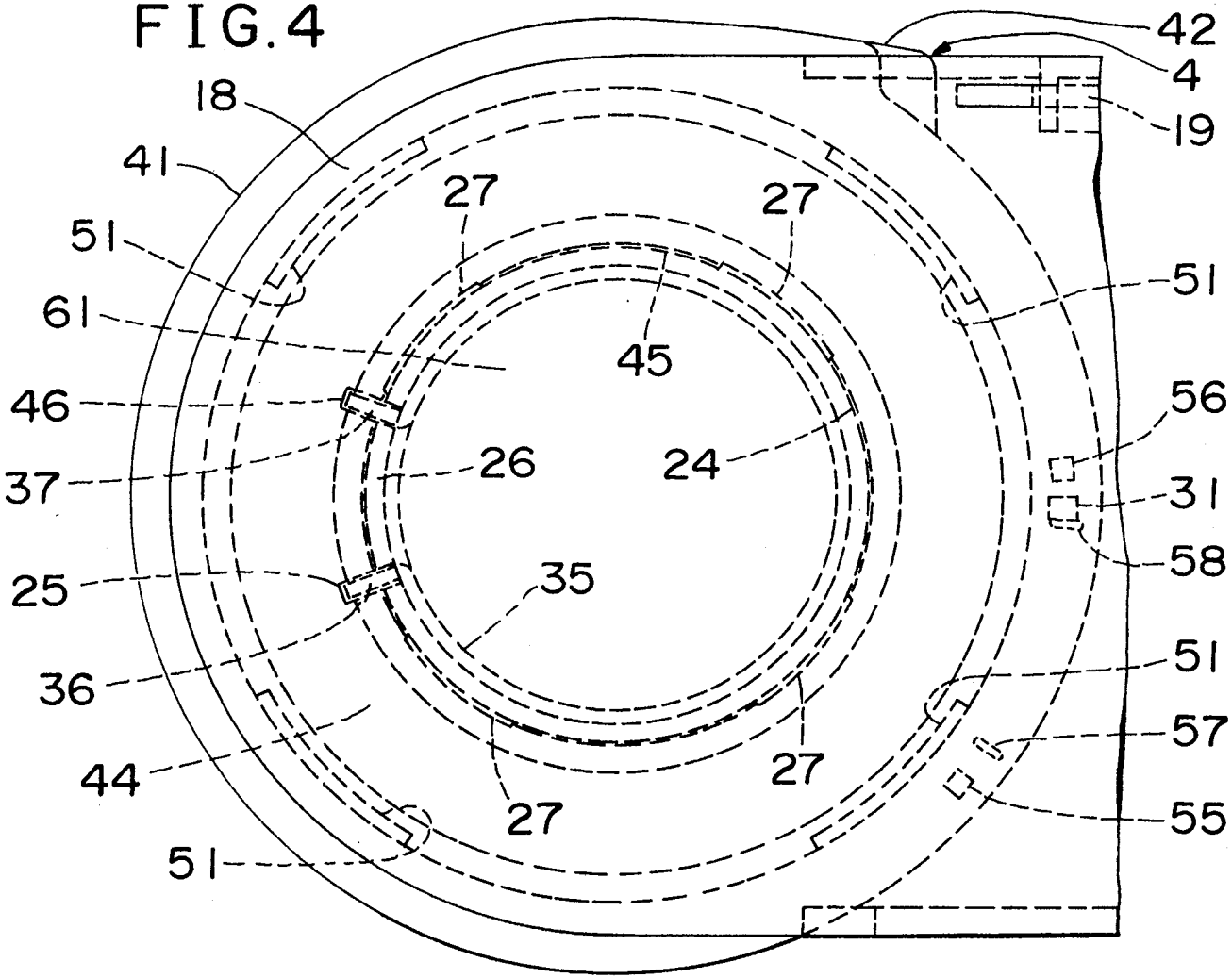
FIG. 4 is a plan view of a main part of a cover in the airtight compact case according to the first embodiment.
Figure 5:
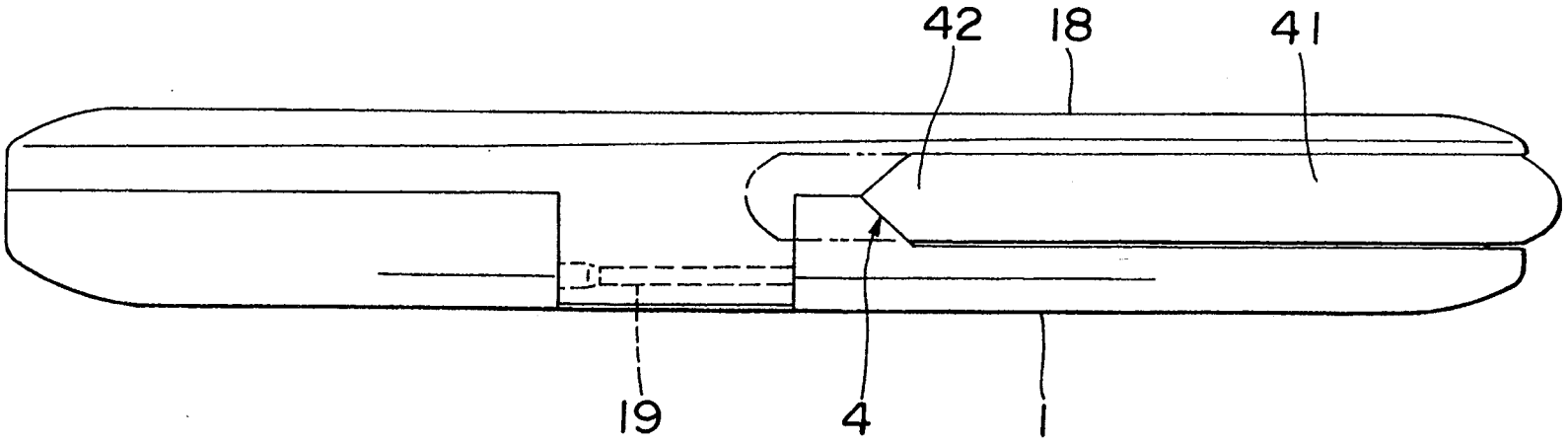
FIG. 5 is a rear view of the airtight compact case according to the first embodiment.
Figure 6:
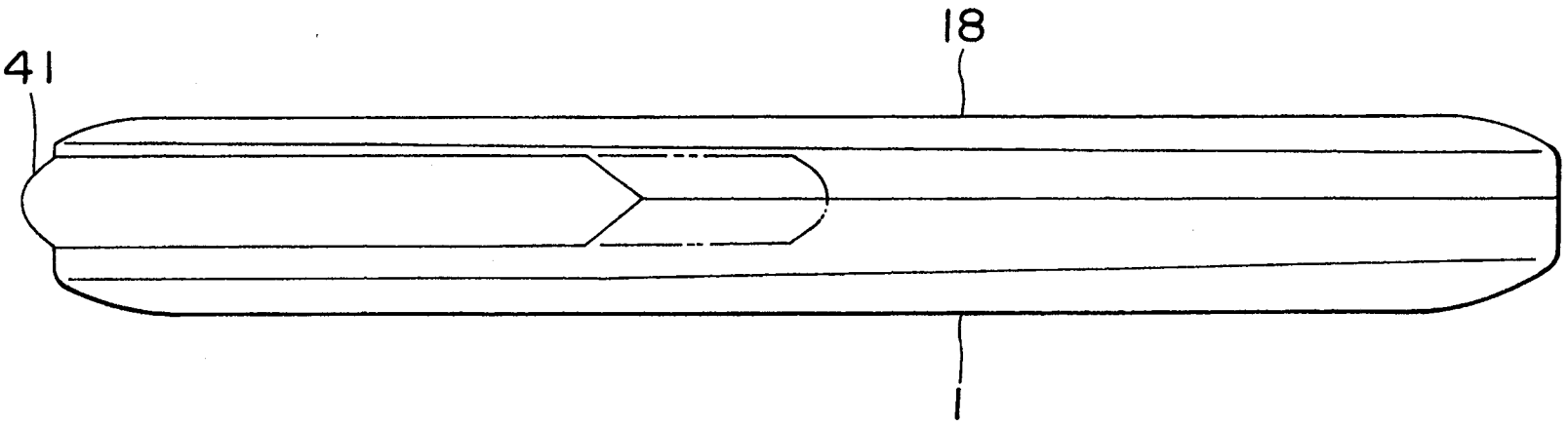
FIG. 6 is a front view of the airtight compact case according to the first embodiment.
Figure 7:
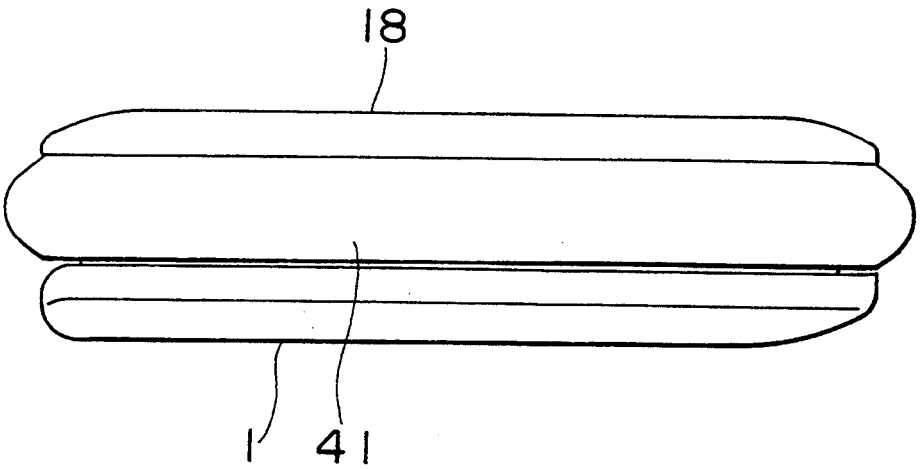
FIG. 7 is a left side view of the airtight compact case according to the first embodiment of this invention.
Figure 8:
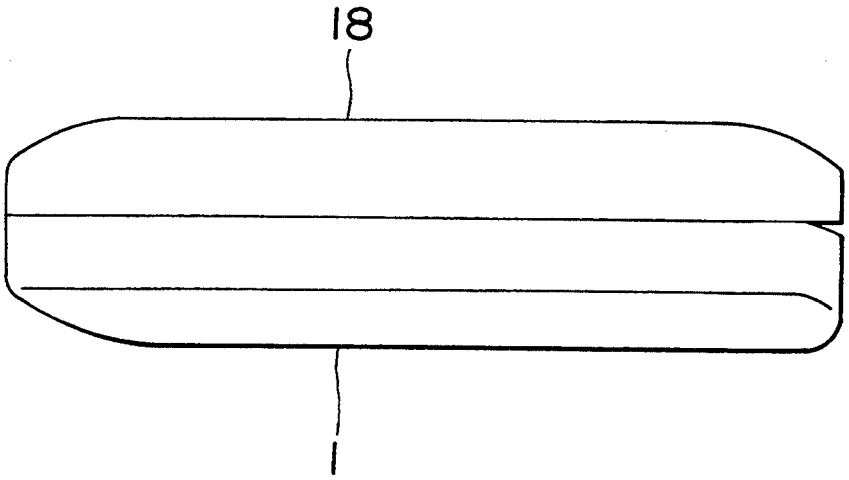
FIG. 8 is a right side view of the airtight compact case according to the first embodiment of this invention.
Figure 9:
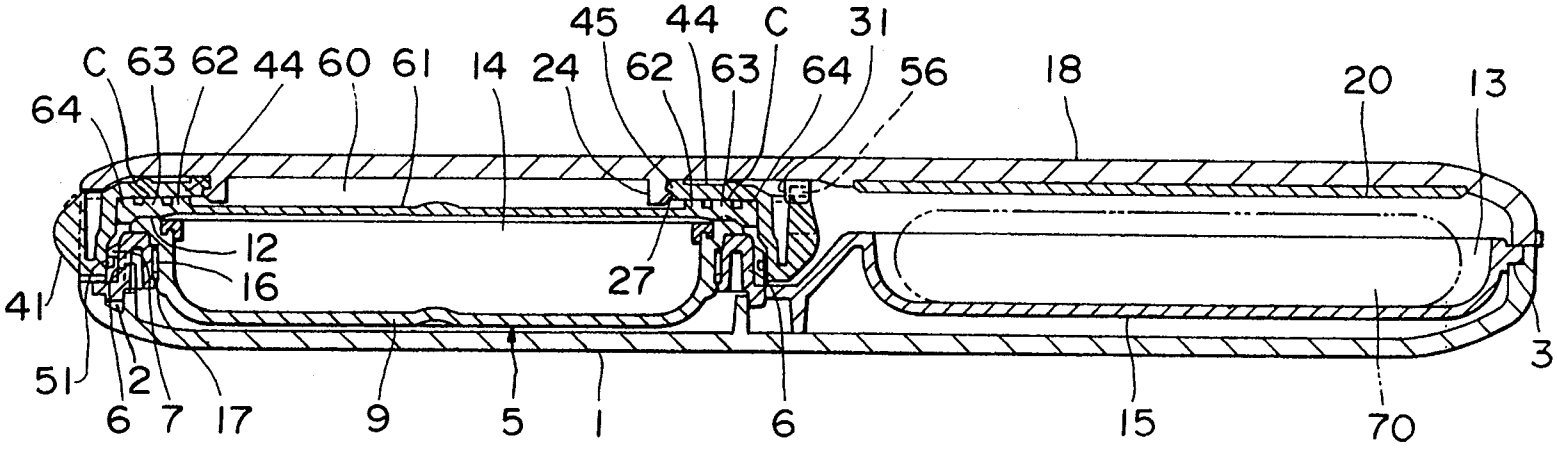
FIG. 9 is a sectional view of an airtight compact case according to a second embodiment of this invention taken along a line II—II in FIG. 10.
Figure 10:
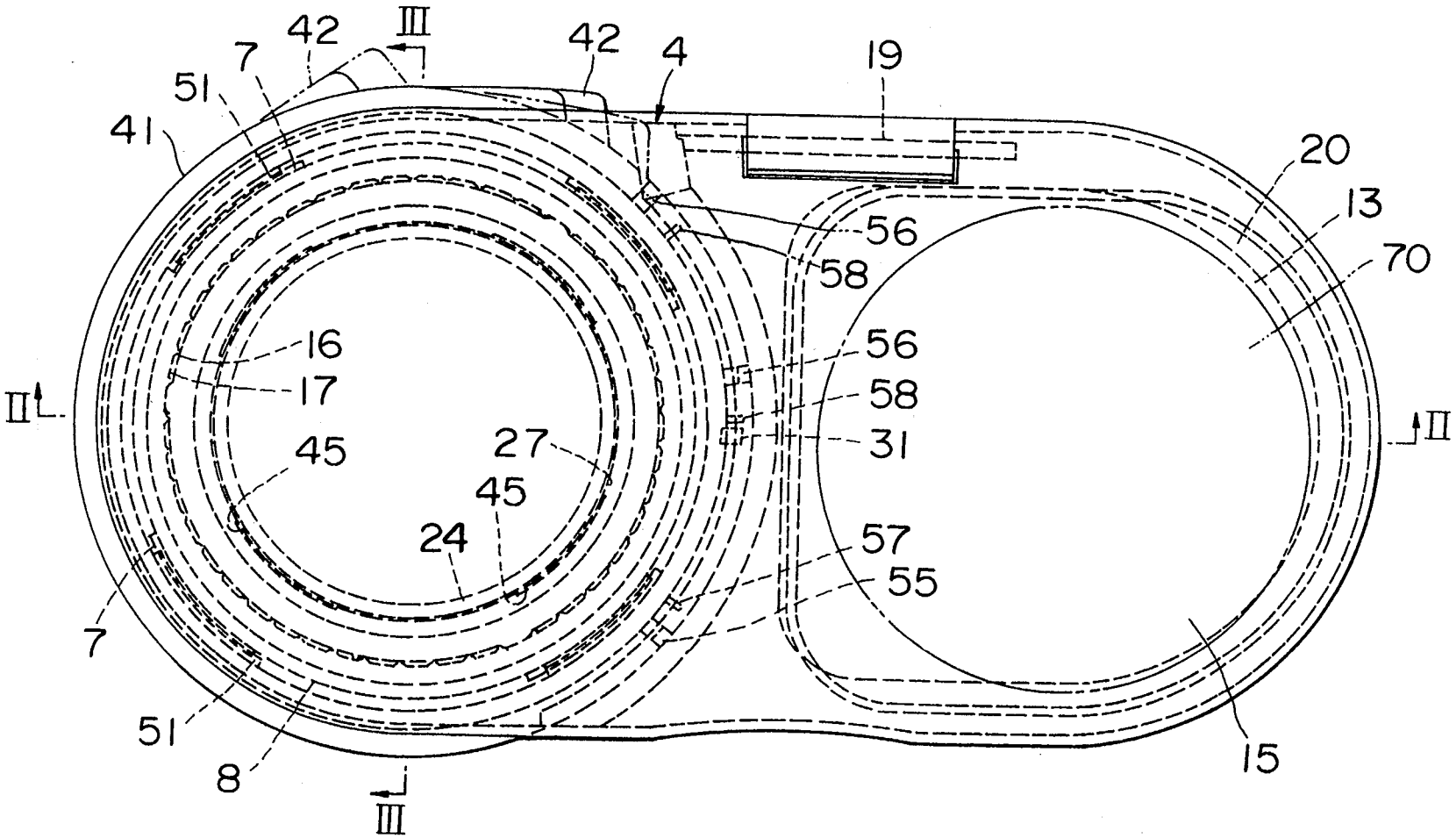
FIG. 10 is a plan view of the airtight compact case according to the second embodiment with a part of a top plate of a cover removed.
Figure 11:
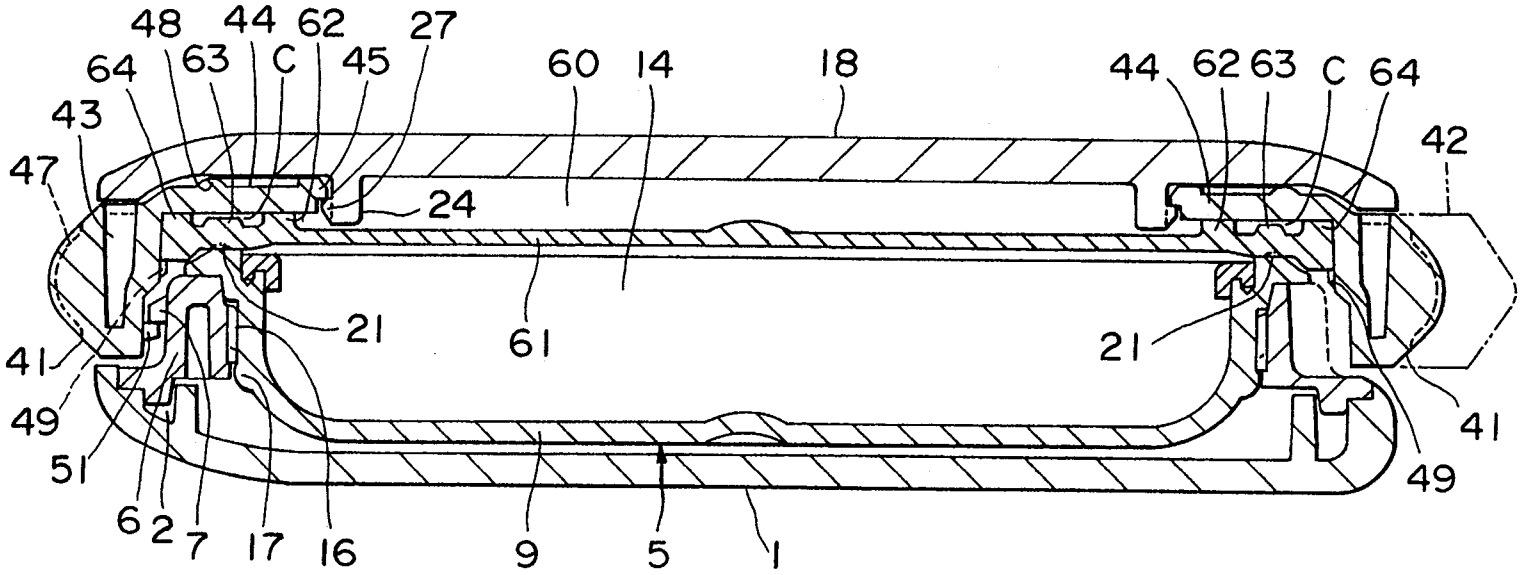
FIG. 11 is a sectional view of the airtight compact case according to the second embodiment taken along a line III—III in FIG. 10.
Figure 12:
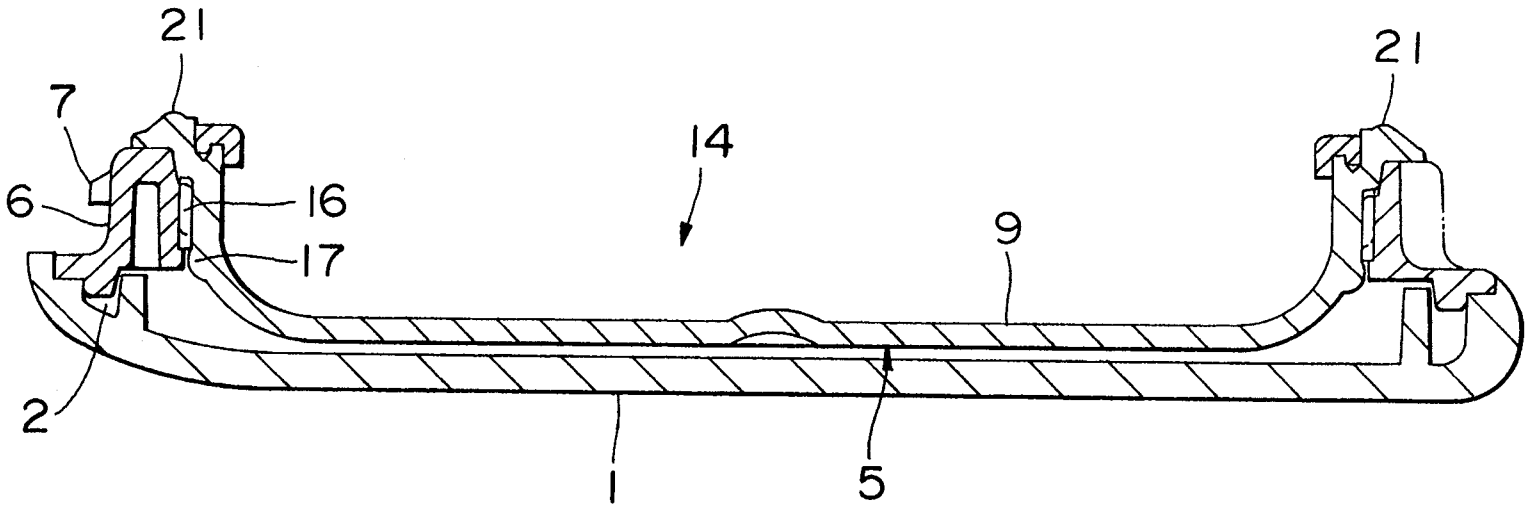
FIG. 12 is an end view of a case body in the airtight compact case according to the second embodiment taken along a line III—III in FIG. 10.
Figure 13:
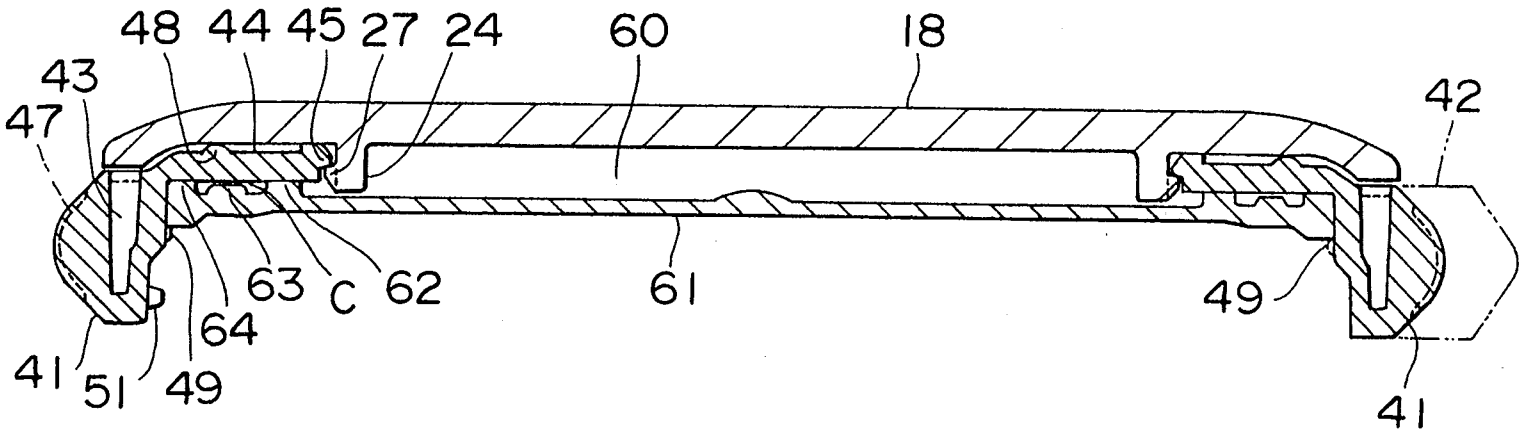
FIG. 13 is an end view of a cover in the airtight compact case according to the second embodiment taken along a line III—III in FIG. 10.
Figure 14:
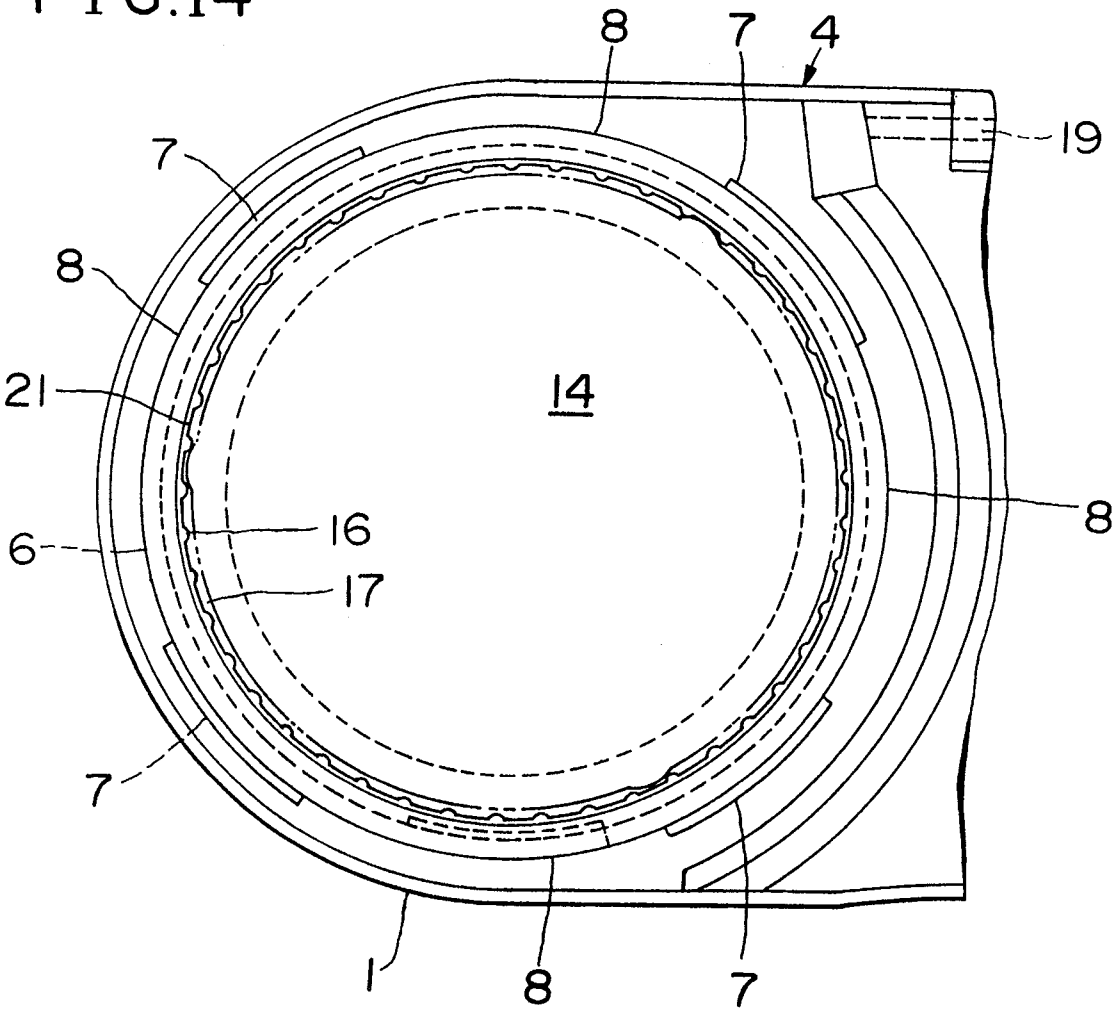
FIG. 14 is a plan view of a main part of the case body in the airtight compact case according to the second embodiment.
Figure 15:
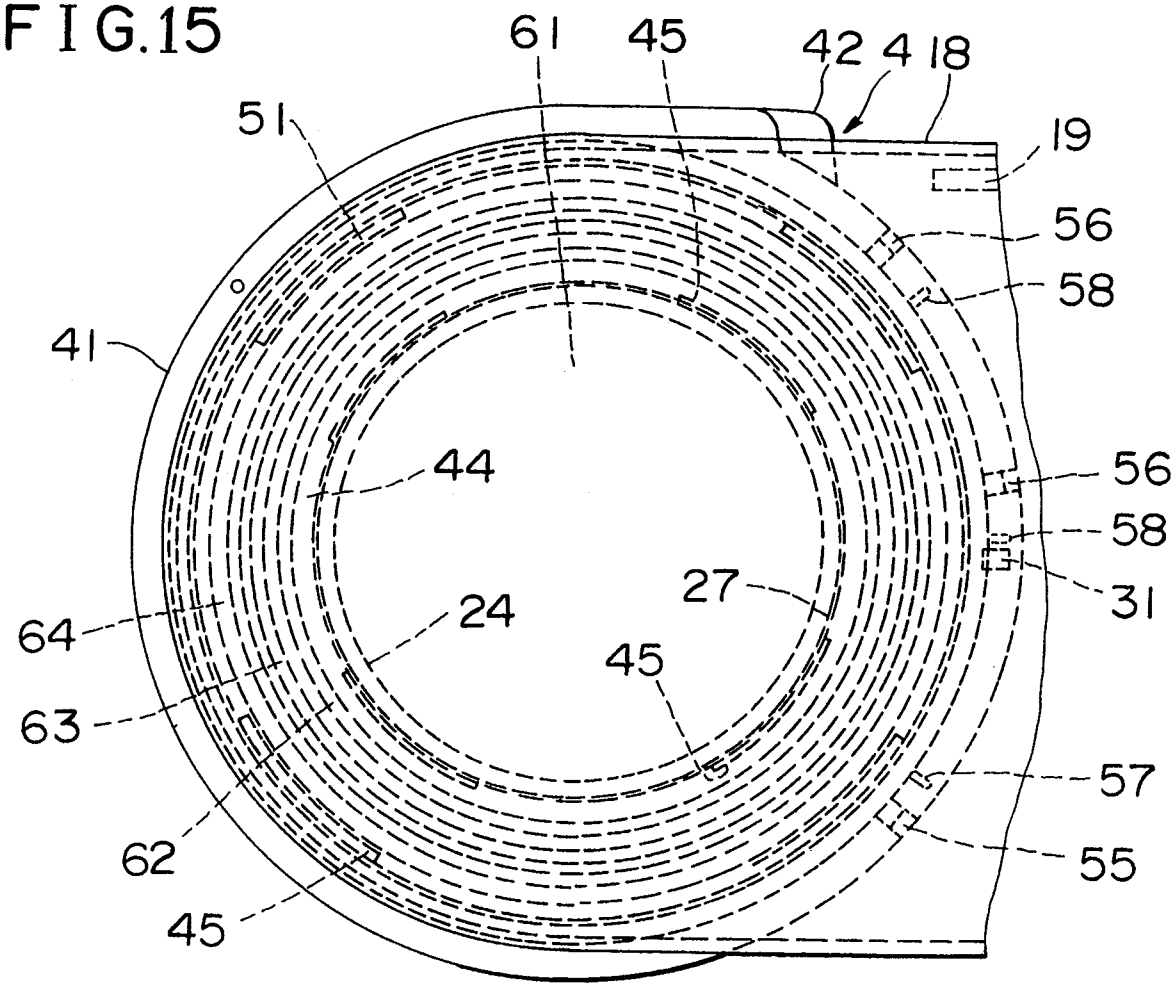
FIG. 15 is a plan view of a main part of the cover in the airtight compact case according to the second embodiment.
Figure 16:
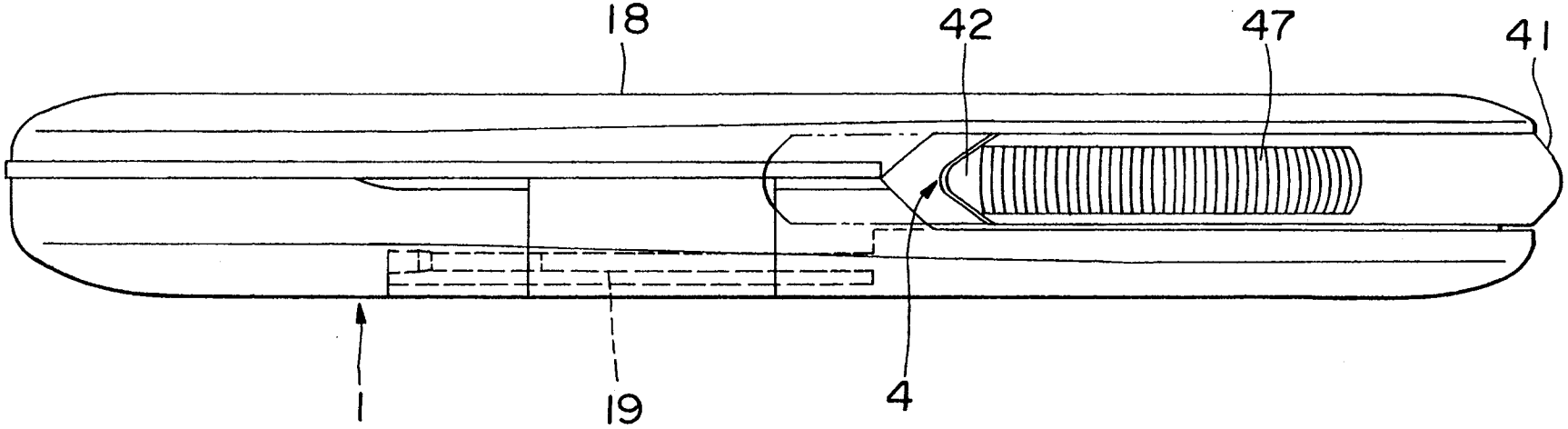
FIG. 16 is a rear view of the airtight compact case according to the second embodiment.
Figure 17:
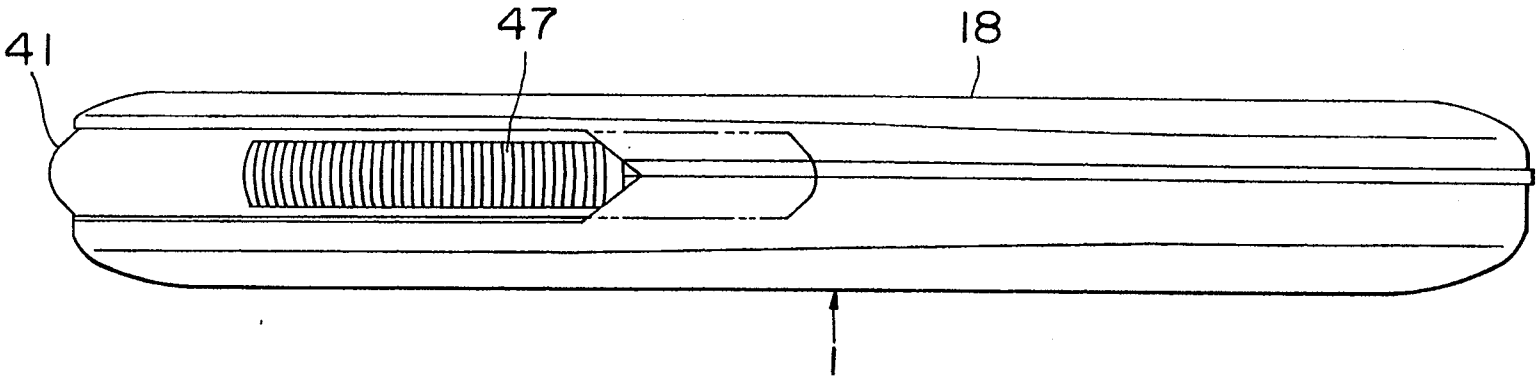
FIG. 17 is a front view of the airtight compact case according to the second embodiment.
Figure 18:
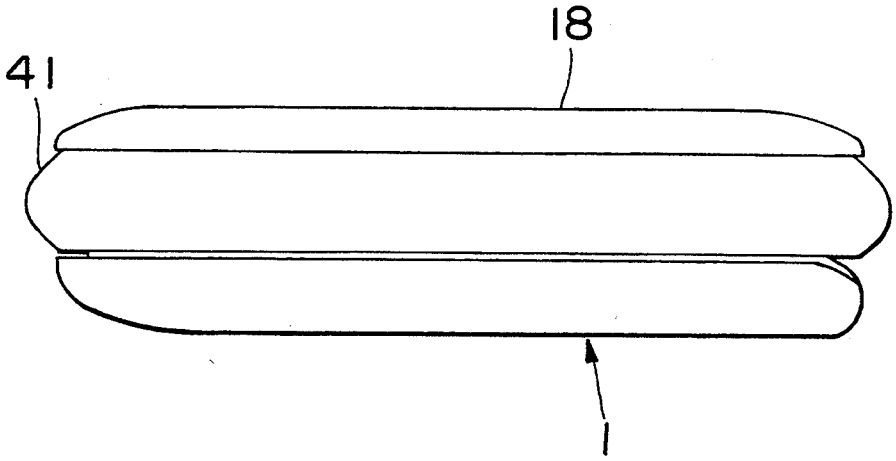
FIG. 18 is a left side view of the airtight compact case according to the second embodiment.
Figure 19:
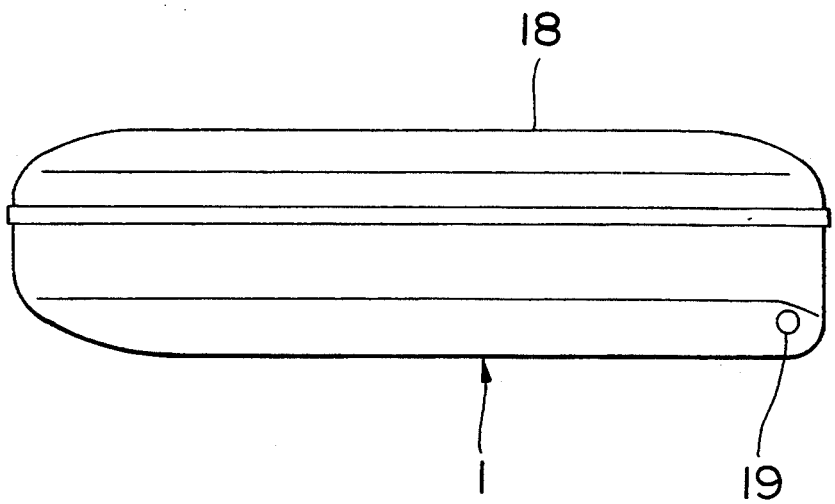
FIG. 19 is a right side view of the airtight compact case according to the second embodiment.

As illustrated in FIGS. 1 through 3 (In FIG. 1, a ring 41 is rotated to an opening position. In FIG. 2, a part of a top plate of the cover 18 is removed.), the peripheral wall 6 of the inner tray 5 is provided with male thread portions 7 and unthreaded portions 8 alternately intermittently formed on the outer surface thereof. The male thread portions 7 form a multiple thread (a quadruple thread in this embodiment). The male thread portions 7 and the unthreaded portions 8 are formed at four positions on the outer surface of the peripheral wall 6. Each of the male thread portions 7 has a circumferential length smaller than that of each unthreaded portion 8.

An annular protrusion 10 is formed at an outer edge of an upper surface of the peripheral wall 6 and acutely protrudes upward. Likewise, an annular projection 11 is formed at an inner edge of the upper surface of the peripheral wall 6 and protrudes upward. An engaging projection 12 is formed on an inner surface of the peripheral wall 6.

A tray member 9 of stainless steel is fitted inside of the peripheral wall 6 and defines a cosmetic container section 14. Specifically, an upper portion of the tray member 9 is engaged with the annular projection 11 of the peripheral wall 6. The tray member 9 has a groove formed on an outer peripheral surface of its body and engaged with the engaging projection 12. Thus, the tray member 9 is fixed. A combination of the peripheral wall 6 and the tray member 9 forms the inner tray 5. The tray member 9 forms a part of the peripheral wall 6. The peripheral wall 6 and the tray member 9 may be formed into a single integral unit as the inner tray 5.

An annular protrusion 24 downwardly protrudes from a lower surface of the cover 18 in an area covering the inner tray 5. Engaging step portions 27 are outwardly formed at four positions on an outer periphery of the lower end of the annular protrusion 24.

A helical spring 35 is inserted inside of the annular protrusion 24. The spring 35 has one end 36 protruding outward to be fixedly inserted into a spring fixing hole 25 formed in the cover 18. The other end 37 of the spring 35 protrudes outward through an opening 26 formed on the lower side of the annular protrusion 24 to be fixedly engaged with a spring holder 46 formed on a flange portion 44 of a ring 41 which will later be described. The ring 41 is urged by the spring 35 in a closing direction which is a clockwise direction in FIG. 2.

The circular ring 41 of synthetic resin is attached to the lower surface of the cover 18 on the periphery of the side provided with the annular protrusion 24 in the manner that the circular ring 41 is rotatable and inhibited from being released downward. The circular ring 41 is externally fitted to the peripheral wall 6 of the inner tray 5.

In each of the cover 18 and the case body 1 at the side provided with the ring 41, a part of a front wall, a side wall, and a part of a rear wall are removed. Contiguous to the removed portion of the rear wall, a cutoff portion 4 is formed.

An outer peripheral portion of the ring 41 attached to the cover 18 is outwardly expanded through the removed portions formed at a part of the front wall, the side wall, and a part of the rear wall of each of the cover 18 and the case body 1.

A protrusion 42 is formed on the outer peripheral portion of the ring 42. When the ring 41 is located at a closed position, the protrusion 42 is located adjacent to the cutoff portion 4 formed on the rear wall of each of the cover 18 and the case body 1 to close the cutoff portion 4.

The ring 41 is provided with an annular cavity 43 intermittently formed. The inward flange portion 44 is integrally formed on an upper portion of the ring 41. The flange portion 44 has an annular engaging projection 45 formed on its inner edge. The engaging projection 45 is mounted on the engaging step portions 27 formed on the annular protrusion 24. Thus, the ring 41 is attached to the cover 18 so that the ring 41 is rotatable and inhibited from being released downward.

The ring 41 has female thread portions 51 which are intermittently formed at four positions on its inner peripheral surface and which constitute a quadruple thread as a multiple thread. Each of the female thread portions 51 has a circumferential length smaller than that of each unthreaded portion 8 of the inner tray 5. The female thread portions 51 are engaged with the male thread portions 7 of the peripheral wall 6 to tightly fasten the cover 18 to the case body 1. When the female thread portions 51 meet the unthreaded portions 8 of the peripheral wall 6 through rotation of the ring 41, the cover 18 is allowed to be released from the case body 1.

A disc-shaped elastic inner cover 61 made of synthetic rubber or elastomer is fitted to the lower surface of the flange portion 44 of the ring 41 and to the lower side of the annular protrusion 24 formed on the cover 18. The inner cover 61 is for sealing the open edge of the inner tray 5. A space 60 is left between the lower surface of the cover 18 and the inner cover 61. The peripheral edge of the inner cover 61 is tightly fitted and fixed to the upper portion of the inner peripheral surface of the ring 41. The lower surface of the inner cover 61 is entirely covered by aluminum foil.

A stopper 31 protrudes from the lower surface of the cover 18 at a position on the side of the inner tray 5 and near to the second inner tray 15. On the other hand, the ring 41 is provided with an opening-side contact piece 55, an opening-side elastic piece 57, a closing-side contact piece 56, and a closing-side elastic piece 58 formed on its upper surface at an area near to the second inner tray 15.

The opening-side contact piece 55, the opening-side elastic piece 57, the closing-side contact piece 56, and the closing-side elastic piece 58 are arranged in the following manner. As depicted by a dash-and-double dot line in FIG. 2, the ring 41 is rotated in the counterclockwise direction. When the female thread portions 51 of the ring 41 meet the unthreaded portions 8 of the peripheral wall 6, the Opening-side elastic piece 57 protruding from the upper surface of the ring 41 passes over the stopper 31 protruding from the lower surface of the cover 18 to generate a click sound. Subsequently, the opening-side contact piece 55 is brought into contact with the stopper 31 to stop the rotation of the ring 41.

On the other hand, let the ring 41 be rotated in the clockwise direction. When the female thread portions 51 of the ring 41 are engaged with the male thread portions 7 of the peripheral wall 5, the closing-side elastic piece 58 protruding from the upper surface of the ring 41 passes over the stopper 31 to generate a click sound. Subsequently, the closing-side contact piece 56 is brought into contact with the stopper 31 to stop the rotation of the ring 41.

In this embodiment, the opening-side elastic piece 57 has a strength such that, after the opening-side elastic piece 57 passes over the stopper 31, the ring 41 is held at that position (open position) against the urging force of the spring 35. Alternatively, the opening-side elastic piece 57 may have a strength such that the ring 41 is not held at that position against the urging force of the spring 35 and therefore the ring 41 is automatically returned to the closed position when ring 41 is released from the hand.

The airtight compact case is operated as follows. After the ring 41 is brought to the open position, the cover 18 is turned and put on the case body 1 and the ring 41 is rotated in the closing direction or the clockwise direction. The female thread portions 51 are engaged with the male thread portions 7 on the peripheral wall 6. The closing-side elastic piece 58 of the ring 41 passes over the stopper 31 to generate a click sound which announces that the ring 41 is rotated to the closed position. Then, the closing-side contact piece 56 of the ring 41 is brought into contact with the stopper 31 of the cover 18 to stop the rotation of the ring 41.

At this time, the protrusion 42 of the ring 41 is rotated to reach the cutoff portion 4 formed on the rear side of each of the case body 1 and the cover 18 to close the cutoff portion 4.

Engagement between the male thread portions 7 and the female thread portions 51 intermittently formed as multiple threads on the outer surface of the peripheral wall 6 and the inner peripheral surface of the ring 41 brings the ring 41 into strong press contact with the open edge of the inner tray 5 by a small angle rotation of the ring 41. An entire surface of the outer periphery of the inner cover 61 is uniformly brought into press contact with the open edge of the inner tray 5. Thus, the cosmetic container section 14 is airtightly sealed.

It is assumed that the temperature of the airtight compact case is raised due to an increase of atmospheric temperature. Consequently, the temperature of air within the cosmetic container section 14 is increased. This results in an increase of the pressure within the cosmetic container section 14. In this event, the inner cover 61 is elastically expanded upwards as illustrated by a dash-and-double dot line in FIG. 1 to thereby increase the volume of the cosmetic container section 14. Thus, the increase of the pressure within the cosmetic container section 14 is suppressed so as to avoid interruption of the sealing condition of the cosmetic container section 14 and to support the sealing force of the inner cover 61 strongly pressed against the open edge of the inner tray 5 as described above.

On the other hand, even if the temperature within the cosmetic container section 14 is lowered to cause a negative pressure therein, the cosmetic container section 14 is sealed by the inner cover 61 pressed by the thread portions. Accordingly, atmospheric air never flows into the cosmetic container section 14. In addition, when the cosmetic container section 14 has a negative pressure therein, the inner cover 61 is downwardly bent so as to prevent the cosmetic container section 14 from further decrease in pressure.

Even if the cosmetic product in the cosmetic container section 14 contains an evaporable substance, it is possible to prevent the substance from evaporating and leaking out to be reduced in amount.

The ring 41 is urged by the spring 35 in the closing direction so that the ring 41 is not loosened due to vibration and so on.

To open the cover 18, the ring 41 is rotated against the urging force of the spring 35 in the opening direction which is the counterclockwise direction. When the ring 41 is rotated until the opening-side elastic piece 57 passes over the stopper 31, the opening-side elastic piece generates a click sound. Subsequently, the ring 41 is rotated until the opening-side contact piece 55 is brought into contact with the stopper 31. At that time, the female thread portions 51 of the ring 41 meet the unthreaded portions 8 of the peripheral wall 6. In other words, the female thread portions 51 are released from the engagement with the male thread portions 7 to thereby allow the cover 18 to be opened.

It will be understood that the number of threads of each of the male and the female thread portions 7 and 51 may be varied. The number of the male and the female thread portions 7 and 51 may be varied also.

Second Embodiment

Referring to FIGS. 9 through 19, an airtight compact case according to a second embodiment of this invention will be described. The similar parts are designated by like reference numerals as in the first embodiment and will not be described any longer. The following description is directed to the structure different from the first embodiment.

In this second embodiment, a mirror 20 is attached to the rear surface of the cover 18.

In the first embodiment, the tray member 9 has the groove formed on the outer peripheral surface of its body and engaged with the engaging projection 12 of the peripheral wall 6 to thereby fix the tray member 9. On the other hand, in the compact case according to the second embodiment, engaging portions 16 and 17 protrude from the inner surface of the peripheral wall 6 and the outer peripheral surface of the tray member 9, respectively. The engaging portion 17 of the tray member 9 is engaged with the lower side of the engaging portion 16 of the peripheral wall 6 to fix the tray member 9.

In the second embodiment, an uneven portion 47 is formed on the outer periphery of the ring 41. An annular projection 48 is formed on the upper surface of the flange portion 44 of the ring 41. The inner cover 61 is engaged with an engaging projection 49 formed on the inner peripheral surface of the ring 41. No spring (the spring 35 in the first embodiment) is provided between the cover member 18 and the ring 33.

In the second embodiment, the inner cover 61 is provided with inner and outer annular contact members 62 and 64 upwardly protruding from the upper surface of the peripheral portion thereof to be brought into contact with the flange portion 44 of the ring 41. An intermediate annular contact member 63 is formed between the inner and the outer annular contact members 62 and 64 and protrudes upward. The intermediate annular contact member 63 is slightly (for example, 0.2 mm or so) smaller in height than the inner and the outer annular contact member 62 and 64.

In the second embodiment, a body-side annular contact member 21 is upwardly arcuately protruded from the upper surface of the outer periphery of the tray member 9 of the inner tray 5. The body-side annular contact member 21 is formed so as to be brought into contact with the lower surface of the inner cover 61 at a position below the intermediate annular contact member 63.

In the compact case according to the second embodiment, when the ring 41 is located at the open position and the inner and the outer annular contact members 62 and 64 are kept in slight contact with the lower surface of the flange portion 44 of the ring 41, a gap C is formed between the intermediate annular contact member 63 and the lower surface of the flange portion 44.

In the above-mentioned state, let the ring 41 be rotated and tightened. In this event, the intermediate annular contact member 63 of the inner cover 61 is not moved down because its lower surface is supported by the body-side annular contact member 21. The inner and the outer annular contact members 62 and 64 are pressed down in relatively strong press contact with the lower surface of the flange portion 44. The peripheral portion of the inner cover 61 is curved in an arcuate shape to be elastically brought into press contact with the body-side annular contact member 21. The intermediate annular contact member 63 is brought into press contact with the lower surface of the flange portion 44 and contracted by about 0.1 mm. The peripheral portion of the inner cover 61 is no longer curved. Thus, the degree of the bend of the peripheral portion of the inner cover 61 is restricted.

Therefore, the inner cover 61 is prevented from being curved and bent to the extent that a next closure is unsuccessful. Even if the cover 18 is closed immediately after it is opened, the inner cover 61 can be elastically brought into press contact with the body-side annular contact member 21. Accordingly, the cosmetic container section 14 is reliably sealed.

In the compact case according to the second embodiment also, the inner cover 61 is elastically deformed in response to temperature variation to vary the volume within the cosmetic container section 14. Thus, pressure variation within the cosmetic container section 14 is suppressed so as to prevent deterioration of the sealing condition of the cosmetic container section 14.

Third Embodiment

Figure 20:
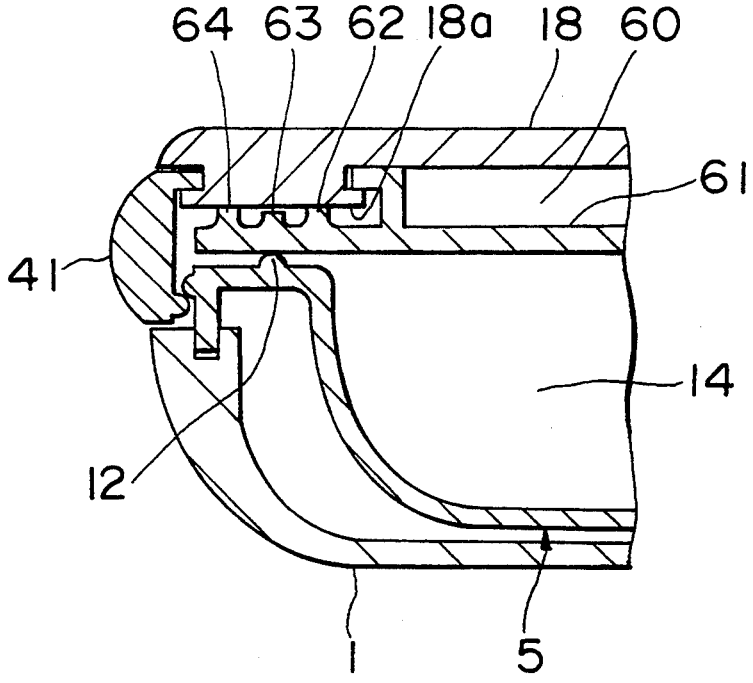
FIG. 20 is a sectional view of a main part of an airtight compact case according to a third embodiment of this invention.

Next referring to FIG. 20, a compact case according to a third embodiment of this invention will be descried. FIG. 20 is an enlarged sectional view of a part of the compact case according to the third embodiment.

In the compact case, the case body 1 has the inner tray 5 formed as an integral unit comprising the peripheral wall 6 and the tray member 9. The inner cover 61 is attached to the rear surface of the cover 18. The inner and the outer annular contact members 62 and 64 are brought into contact with a peripheral lower surface **18*a* of the cover 18. The intermediate annular contact member 63 is allowed to be brought into contact with the peripheral lower surface 18*a* also. The ring 41 is rotatably attached to the outside of the peripheral lower surface 18*a* of the cover 18**. As the other structure is similar to that of the second embodiment, similar parts are designated by like reference numerals and will not be described any longer. The compact case according to the third embodiment provides the operation and the effect similar to those of the second embodiment.

I claim:

1. An airtight compact case comprising:

a case body having a cosmetic container section surrounded by a peripheral wall;

a cover pivotably attached to a rear end of said case body;

an elastic inner cover attached to a lower portion of said cover for sealing an open edge of said peripheral wall;

a cavity defined between a lower surface of said cover and said inner cover;

a ring rotatably and unreleasably attached to the lower portion of said cover and externally fitted to the peripheral wall of said case body;

a plurality of male thread portions intermittently formed as a multiple thread on an outer surface of the peripheral wall of said case body;

a plurality of unthreaded portions formed on the outer surface of the peripheral wall of said case body between said male thread portions; and a plurality of female thread portions intermittently formed as a multiple thread on an inner peripheral surface of said ring to be engageable with and disengageable from said male thread portions so that said cover is allowed to be opened when said female thread portions meet said unthreaded portions and that said cover is brought into press contact with said case body and said inner cover is put into press contact with said peripheral wall when said ring is rotated with said female thread portions engaged with said male thread portions.

2. An airtight compact case as claimed in claim 1, wherein each of said case body and said cover has an elliptical shape, said case body being provided with a puff container section adjacent to said cosmetic container section.

3. An airtight compact case as claimed in claim 1, wherein an outer peripheral portion of said ring is outwardly protruded from said case body and said cover.

4. An airtight compact case as claimed in claim 3, wherein a cutoff portion is formed on a rear wall of each of said case body and said cover while a protrusion is formed on the outer peripheral portion of said ring to close said cutoff portion when said ring is located at a closed position.

5. An airtight compact case as claimed in claim 1, wherein a spring for urging said ring in a closing direction is interposed between said cover and said ring.

6. An airtight compact case as claimed in claim 1, wherein a stopper is formed on the lower surface of said cover to protrude therefrom, said ring being provided with an opening-side contact piece, an opening-side elastic piece, a closing-side contact piece, and a closing-side elastic piece protruding from an upper surface of said ring, said opening-side contact piece, said opening-side elastic piece, said closing-side contact piece, and said closing-side elastic piece being arranged so that said opening-side elastic piece passes over said stopper and said opening-side contact piece is brought into contact with said stopper when said ring is rotated towards the open position and that said closing-side elastic piece passes over said stopper and said closing-side contact piece is brought into contact with said stopper when said ring is rotated towards the closed position.

7. An airtight compact case as claimed in claim 1, wherein said inner cover is attached to the lower portion of said ring.

8. An airtight compact case as claimed in claim 1, further comprising inner and outer annular contact members formed on an upper surface of said inner cover to be brought into contact with the lower surface of said cover, an intermediate annular contact member formed between said inner and said outer annular contact members, and a body-side annular contact member formed on an upper surface of the peripheral wall of said case body to be brought into contact with a lower surface of said inner cover at a position below said intermediate annular contact member, said intermediate annular contact member being faced to the lower surface of said cover with a gap left therebetween when said inner and said outer annular contact members are put in slight contact with the lower surface of said cover, said intermediate annular contact member being brought into press contact with the lower surface of said cover when said inner and said outer annular contact members are brought into strong press contact with the lower surface of said cover.

9. An airtight compact case as claimed in claim 8, wherein each of said inner, said outer, said intermediate, and said body-side annular contact members is formed to have a convex surface.

10. An airtight compact case as claimed in claim 8, wherein a surface of a counterpart member to be contacted by each of said inner, said outer, said intermediate, and said body-side annular contact members is formed into a convex shape.

11. An airtight compact case as claimed in claim 8, wherein said inner, said outer, and said intermediate annular contact members are brought into direct contact with a rear surface of said cover.

12. An airtight compact case as claimed in claim 8, wherein said inner cover is attached to the lower portion of said ring so that said inner, said outer, and said intermediate annular contact members are brought into contact with a lower surface of said ring.

* * * * *